United States Patent [19]

Matsunaga

[11] 4,134,163

[45] Jan. 16, 1979

[54] AUTOMATIC FLUSHING SYSTEM

[75] Inventor: Masakazu Matsunaga, Asaka, Japan

[73] Assignee: F. M. Valve Manufacturing Co., Ltd., Asaka, Japan

[21] Appl. No.: 834,465

[22] Filed: Sep. 19, 1977

[30] Foreign Application Priority Data

Sep. 27, 1976 [JP] Japan ..... 51-115623

[51] Int. Cl.[2] ..... E03D 13/00

[52] U.S. Cl. ..... 4/302; 4/304; 4/305

[58] Field of Search ..... 4/100, DIG. 3, 249, 4/101, 99, 95, 249, 67 R, 67 A, 34, 11, 302, 303, 304, 305

[56] References Cited

U.S. PATENT DOCUMENTS

| | | | |
|---|---|---|---|
| 2,395,150 | 2/1946 | Sloan et al. | 4/DIG. 3 |
| 2,438,207 | 3/1948 | Derby | 4/DIG. 3 |
| 2,786,210 | 3/1957 | Fraser | 4/101 |
| 3,066,314 | 12/1962 | Filliung | 4/101 |
| 3,835,478 | 9/1974 | Molus | 4/DIG. 3 |
| 3,908,204 | 9/1975 | Hopkins | 4/100 |

FOREIGN PATENT DOCUMENTS

| | | | |
|---|---|---|---|
| 1124436 | 2/1962 | Netherlands | 4/DIG. 3 |

*Primary Examiner*—Henry K. Artis
*Attorney, Agent, or Firm*—Bacon & Thomas

[57] ABSTRACT

An automatic flushing system for flushing a plurality of toilet bowls with water, which is provided with a solenoid-controlled valve and a detecting device. So long as the detecting appliance detects no toilet user, the solenoid-controlled valve is opened every time a predetermined time lapses, thereby to flush all the toilet bowls. If only one toilet user is detected, the solenoid-controlled valve is opened thereafter upon lapse of a reference time shorter than the predetermined time, thereby to flush the toilet bowls. If two or more toilet users are detected, the solenoid-controlled valve is opened thereafter upon lapse of a time shorter than the reference time, the time being shorter by a predetermined length for each additional toilet user detected.

9 Claims, 5 Drawing Figures

AUTOMATIC FLUSHING SYSTEM

BACKGROUND OF THE INVENTION

This invention relates to an automatic flushing system for flushing at once a plurality of toilet bowls installed in a lavatory.

Public lavatories in the buildings, railway stations or the like are provided each with a relatively large number of stools and urinals. In such a public lavatory the users should operate the flushing system to flush the stools or urinals they have just used. But the users often forget to operate the flushing system, thus leaving the lavatory in an unhygienic condition. To keep clean the toilet bowls of a public lavatory, use has been made commonly of an automatic flushing system which flushes all the toilet bowls automatically at predetermined intervals. This system, however, is extremely uneconomical. It wastes a great amount of water since the toilet bowls are flushed repeatedly even if none of them is used for a long time, for example in the midnight-to-morning period. To save water, the attendant must turn off the timer of the flushing system late at night and turn it on early in the morning next day, thereby to keep the toilet bowls unflushed during the midnight-to-morning period. This is a drawback of this flushing system.

To eliminate the drawback of the above-mentioned flushing system, there has been invented an automatic flushing system which flushes toilet bowls every time a predetermined number of persons are detected to have used the lavatory. As well known, public lavatories are used at an irregular frequency. If a lavatory with such an automatic flushing system is used at a low frequency, its toilet bowls are left unflushed for a long time. Thus, the lavatory may often get dirty and give forth an offending smell outside. For this reason this automatic flushing system cannot be employed in public lavatories at any places.

SUMMARY OF THE INVENTION

The object of this invention is to provide an automatic flushing system which is free of the above-mentioned drawbacks of the known systems and which flushes toilet bowls of a lavatory upon lapse of a reference time after one person has used the lavatory and upon lapse of a time shorter than the reference time after two or more persons have used the lavatory, the time being shorter by a predetermined length for each additional toilet user.

The automatic flushing system according to this invention comprises a detecting device for delivering a detection signal upon detecting each person entering a lavatory and a solenoid-controlled valve for flushing the toilet bowls of the lavatory. The system further comprises a first command circuit for delivering a first output signal in response to a detection signal delivered first from the detecting device after the flushing of the toilet bowls; a first signal-transmitting circuit having a first timer which starts upon receipt of the first output signal and stops upon lapse of a first reference time, thereby to deliver a second output signal when the first timer stops; a timer for delivering, upon receipt of the second output signal, a third output signal which lasts for a predetermined time to control the solenoid-controlled valve; means for actuating the solenoid-controlled valve upon receipt of the third output signal, thereby to flush the toilet bowls; a second command circuit for delivering a fourth output signal to the first signal-transmitting circuit upon receipt of every detection signal, except for the one delivered first from the detecting device after each flushing of the toilet bowls, thereby to set in the first timer a time shorter than the first reference time by a predetermined length; a third command circuit for delivering a fifth output signal after each flushing of the toilet bowls in case the detecting device delivers no detection signal; and a second signal-transmitting circuit having a second timer which starts upon receipt of the fifth output signal and stops every time a second reference time longer than the first reference time elapses, thereby to deliver, when the second timer stops, a sixth output signal to the timer for controlling said solenoid-controlled valve, so as to flush the toilet bowls.

The solenoid-controlled valve is opened every time the second reference time, e.g. 2 hours, elapses in case no person uses the lavatory for a longer time. The toilet bowls are therefore never dried too long. Thus, urine or excrement, if remaining despite the previous flushing, is never left in the bowls to give forth an offending smell for a long time, while being dried. In addition, since the flushing system operates at regular intervals even if no person uses the lavatory, it has less chance to have a trouble than otherwise.

If only one person uses the lavatory, the toilet bowls are flushed upon lapse of the first reference time, e.g. 20 minutes, from the person's entering the lavatory. Thus the toilet bowls used by the person is never left unflushed for more than 2 hours. In case a second person, a third person and so forth enter the lavatory, the solenoid-controlled valve is opened upon lapse of a time shorter than the first reference time, shorter by, for instance, 2 minutes for each additional person. In this way, the toilet bowls are flushed more frequently as more people enter the lavatory. Accordingly the automatic flushing system of this invention is free of the drawback of the last-mentioned known system.

DETAILED DESCRIPTION OF THE PREFERRED EMBODIMENT

Figure 1:
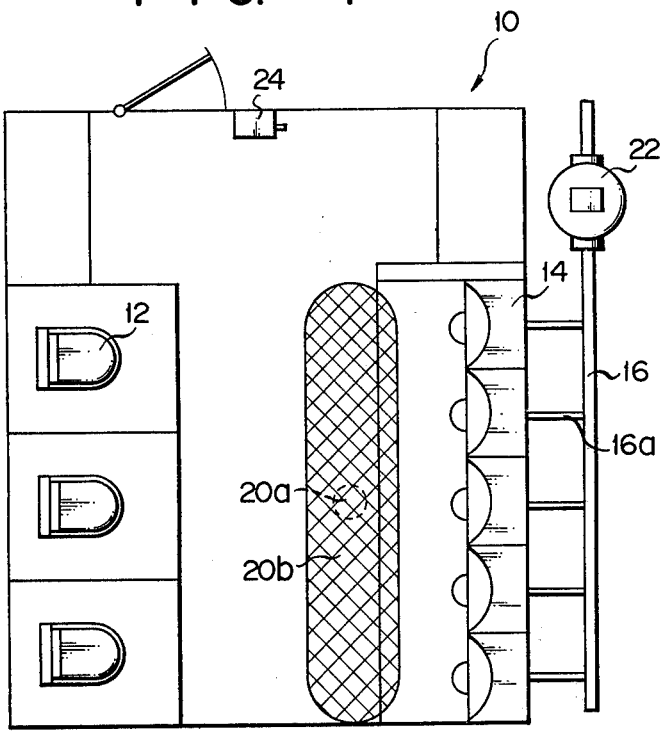
FIG. 1 is a plan view of a lavatory with a plurality of toilet bowls.
Figure 2:
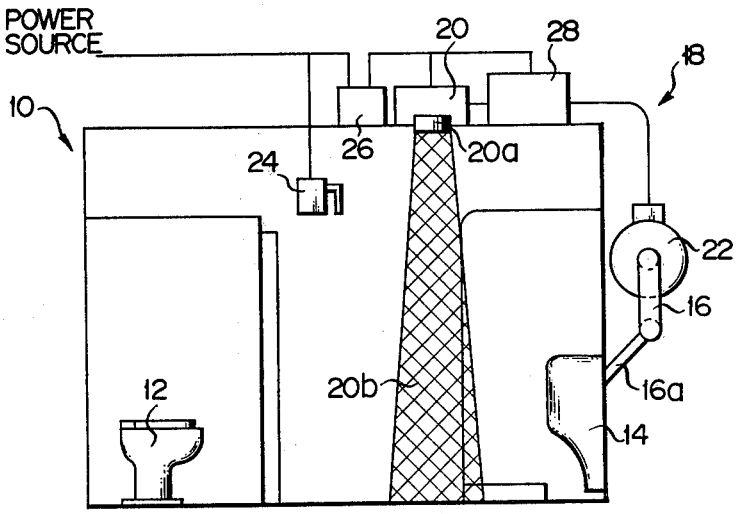
FIG. 2 is a side view of the lavatory shown in FIG. 1.

In the public lavatory 10 shown in FIGS. 1 and 2 there are arranged a plurality of stools 12 and a plurality of urinals 14. The urinals 14 are connected to a flush pipe 16 through pipes 16*a*, respectively. Since the embodiment of this invention is to be described as an automatic flushing system for the urinals 14, the stools 12 are not illustrated in detail in FIGS. 1 and 2.

The embodiment of the invention, i.e. automatic flushing system 18 comprises a detecting device 20 for delivering a detection signal every time any urinal 14 is used, a solenoid-controlled valve 22 connected to the flush pipe 16 so as to effect the flushing of the urinals 14 and a control device 28 for delivering an output signal to actuate the solenoid-controlled valve 22. The detecting device 20 utilizes ultrasonic waves and includes a transducer 20*a* fixed on the ceiling of the lavatory. The transducer 20*a* emits ultrasonic waves into a limited oblong space 20*b* into which people have to step in order to use any one of the urinals 14. If a person steps into the space 20*b*, the ultrasonic waves are reflected from the person. Upon receipt of the reflected ultrasonic waves, the detecting device 20 supplies a detection signal to the control device 28. The detection signal therefore indicates that one person has stepped into the space 20*b*, who is supposed to use one of the urinals 14.

The automatic flushing system 18 is supplied with electric power via switching box 24 from a power source. A constant voltage generating circuit 26 is provided to ensure a constant power supply to the flushing system 18.

The detection signal is transferred from the control device 28 to the solenoid-controlled valve 22. Upon receipt of the detection signal, the solenoid-controlled valve 22 opens to flush all the urinals 14.

Figure 3:
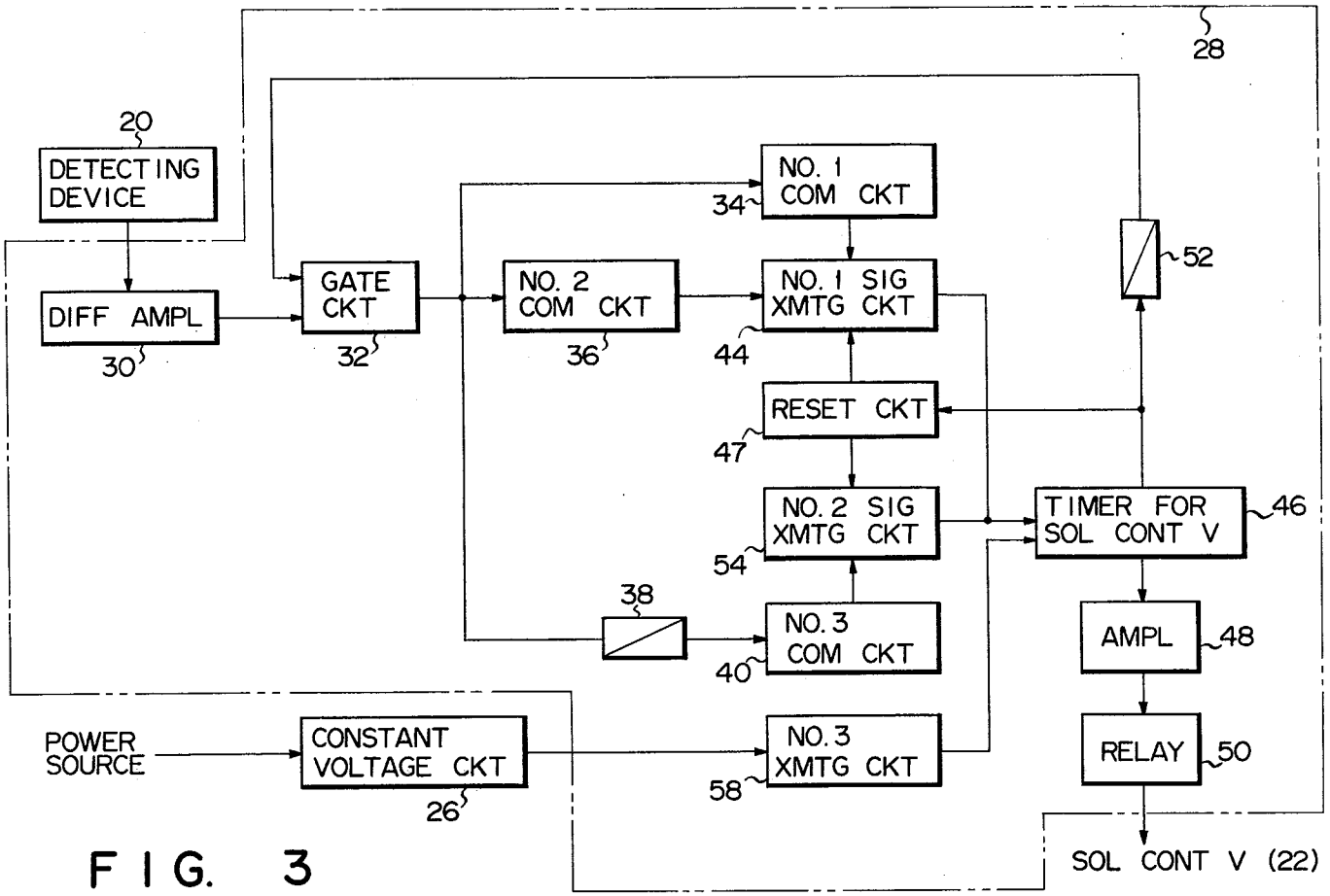
FIG. 3 is a block diagram of a circuit for controlling a solenoid-controlled valve.

FIG. 3 is a block diagram showing the fundamental circuit arrangement of the control device 28 according to one embodiment of this invention. In the control device 28, a detection pulse signal from the detection device 20 is amplified by a differential amplifier 30. The amplified detection signal is then supplied to a gate circuit 31 so as to have a proper pulse width. The detection signal now having a proper pulse width is supplied to a first command circuit 34, a second command circuit 36. It is supplied also to a third command circuit 40 via a NOT circuit 38. The output signals of the first and second command circuits are fed to a first signal-transmitting circuit 44.

If a person steps into the space 20*b* after the solenoid-controlled valve has been opened and thus the urinals 14 have been flushed, the detecting device 20 delivers a first detection signal to the differential amplifier 30. Then the first detection signal is supplied to the gate circuit 32, then to both the first command circuit 34 and the second command circuit 36 and finally to the first signal-transmitting circuit 44 which includes a first timer (not shown in FIG. 3). The first timer starts upon receipt of the detection signal and stops upon lapse of a first reference time. When it stops, the timer generates an electric signal. The first signal-transmitting circuit 44 amplifies this electric signal and produces an output signal, which is transmitted to a timer 46 for the solenoid-controlled valve 22. Upon receipt of the output signal of the first signal-transmitting circuit 44, the timer 46 produces an output signal which lasts for a proper time. The output signal of the timer 46 is supplied to the solenoid-controlled valve 22 through an amplifier 48 and a relay 50. Actuated by this output signal, the valve 22 opens to flush all the urinals 14.

If a second person, a third person and so forth step into the space 20*b*, the detecting device 20 delivers detection signals. These detection signals are amplified one after another by the differential amplifier 30 and then supplied to the gate circuit 32. Upon receipt of each of these detection signals from the gate circuit 32, the second command circuit 36 supplies an output signal to the first timer so that the first timer is reset upon lapse of a time shorter than the first reference time by a predetermined length.

Suppose the first reference time is selected to be 20 minutes, and the predetermined length of time to be 2 minutes. Then, if only one person steps into the space 20*b*, the solenoid-controlled valve 22 is opened 20 minutes later. If a second person follows the suit of the first person within 20 minutes, the solenoid-controlled valve 22 is opened upon lapse of 18 minutes after the first person has stepped into the space 20*b*. If a third person follows the suit of the second person within 18 minutes, the solenoid-controlled valve 22 is opened upon lapse of 16 minutes after the first person has stepped into the space 20*b*. Thus, the more peoples uses the urinals 14, the sooner the urinals 14 are flushed.

The output signal of the timer 46 is supplied to the gate circuit 32 via a NOT circuit 52. This output signal prohibits the gate circuit 32 from delivering a detection signal from the detecting device 20. Thus, even if a person steps into the space 20*b* while the urinals 14 are being flushed, no detection signal is emitted from the gate circuit 32. Further, the output signal of the timer 46 is supplied also to the first signal-transmitting circuit 44 through a reset circuit 47, thus resetting the first timer. Thereafter, the first timer remains to count the first reference time until it receives an output signal of the second command circuit 36.

As mentioned above, the third command circuit 40 receives the output signal of the gate circuit 32 through the NOT circuit 38 every time the detecting device 20 detects a person. If the detecting device 20 detects no person right after each flushing of the urinals 14, a binary-coded signal "1" is supplied to the third command circuit 40. The third command circuit 40 is connected to a second signal-transmitting circuit 54 provided with a second timer and an amplifier circuit (both not shown). The second timer starts upon receipt of a binary-coded signal "1" and stops upon lapse of a second reference time which is longer than the first reference time. When the second timer stops, it produces an output signal. This output signal is amplified by the amplifier circuit and then supplied to the timer 46 through the second signal-transmitting circuit 54. Thus, even if no person uses the urinals 14 at all, the solenoid-controlled valve 22 is opened every time the second reference time, e.g. 2 hours, elapses, thereby flushing the urinals 14.

Every output signal of the timer 46 supplied to the second timer via the reset circuit 47 and the second signal-transmitting circuit 54 as well as to the solenoid-controlled valve 22 via the amplifier 48 and the relay 50. The output signal of the timer 46 resets the second timer and make the second signal-transmitting circuit 54 prepared for next action. Of course the reset circuit 47 feeds the output signal of the timer 46 also to the first signal-transmitting circuit 44 thereby to reset the first timer.

The third signal-transmitting circuit 58 is connected to the constant voltage generating circuit 26. It is provided with a timer which supplies power to the timer 46 only when the switch in the switch box 24 is thrown in and which stops supplying power to the timer 46 after the timer 46 has delivers an output signal. Thus, the solenoid-controlled valve 22 opens to flush the urinals 14 immediately after the switch in the switch box 24 has been thrown in. This flushing serves not only to clean the urinals 14 for first time but also to test the flushing system to see if the system works well.

From the constant voltage generating circuit 26 power is supplied to the circuits other than timer 46. To avoid confusion in understanding FIG. 3, it is not shown in FIG. 3 how to supply power to the other circuits.

The command circuits 34, 36 and 40, the signal-transmitting circuits 44 and 54 and the elements associated with these circuits are specially designed, while the other circuits are of well known types. Thus only the command circuits, the signal-transmitting circuits and elements related with them will now be described in detail.

The first and second timers in the signal-transmitting circuits 44 and 54 are electrolytic timers, e.g. E-cells by Plessey Electro-Product, 3860 Centinela Avenue, Los Angels, Calif., U.S.A. E-cells and their use are disclosed in Bulletin 500 and Application Note No. 5101 both published by Plessey Electro-Product.

An E-cell comprises a first electrode (i.e. silver case) and a second electrode (i.e. central gold electrode). Between the two electrode an electrolyte is sealed. The second electrode is plated gradually with silver as current flows across the two electrodes in one direction, i.e. set direction of the E-cell. If current is made to flow in the opposite direction, i.e. reset direction, the silver is gradually removed from the second electrode and returns to the first electrode. When all the silver is removed from the second electrode, the E-cell is reset. Then the voltage across the electrodes is elevated abruptly. This voltage rise is utilized as a trigger signal to drive other electronic circuits.

As mentioned above, if current flows in such an electrolytic timer in the set direction, the second electrode is gradually plated with silver. The amount of the silver plated on the second electrode is therefore proportional to the electric charge applied to the timer. If current is made to flow in the reset direction, the silver is removed gradually from the second electrode. When all the silver is removed from the second electrode, the timer is reset. Then the voltage between the first and second electrodes is elevated abruptly. The period between the set and reset of the timer is obtained by dividing the electric charge applied to the timer with the reset current. The set-to-reset period can therefore adjusted only by selecting a proper reset current.

Figure 4:
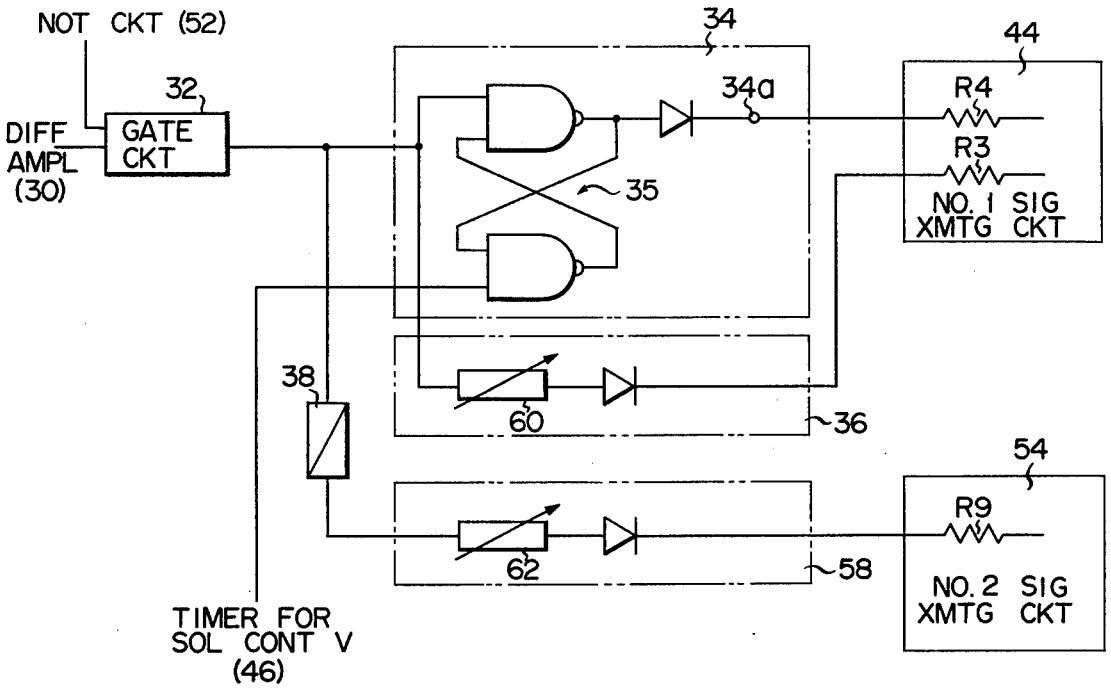
FIG. 4 shows in detail the first command circuit, the second command circuit and the third signal-transmitting circuit — all shown in FIG. 3.

As shown in FIG. 4, the first command circuit 34 includes a bistable flip-flop circuit 35. The flip-flop circuit 35 is reset every time it receives an output signal of the timer 46 through the NOT circuit 52. So long as the flip-flop circuit 35 remains reset, its output terminal 34*a* keeps holding a binary-coded signal "0" until the flip-flop circuit 35 receives an output signal of the gate circuit 32. When the flip-flop circuit 35 receives an output signal of the gate circuit 32, the binary-coded signal "0" is converted into a binary-coded signal "1". Thereafter the output terminal 34*a* keeps holding the binary-coded signal "1" until the flip-flop circuit 35 is reset by an output signal of the timer 46. That is, the output terminal 34*a* starts holding a binary-coded signal "0" when the urinals 14 are flushed and stops holding the binary-coded signal "0" when a first person is detected thereafter. Then it keeps holding a binary-coded signal "1" until the urinals 14 are flushed again.

Every time the binary-coded signal "0" is changed to a binary-coded signal "1", a first reset current of a predetermined value begins flowing from the output terminal 34*a* to the first signal-transmitting circuit 44. The first reset current is determined by a resistor $R_4$ disposed in the first signal-transmitting circuit 44. It is applied to the first timer of the first signal-transmitting circuit 44.

The second command circuit 36 includes a variable resistor 60. Every time the gate circuit 32 delivers an output signal to the second command circuit 36 after the first person has been detected by the detecting device 20, an additional reset current flows through the variable resistor 60 for the time corresponding to the pulse width of the output signal from the gate circuit 32. The additional reset current flows farther to the first timer through a resistor $R_3$ disposed in the first signal-transmitting circuit 44. Thus, the additional reset current flows through the first timer together with the first reset current, every time the detecting device 20 detects a person after the first person has been detected. As a result, the first timer will be reset upon lapse of a time shorter than the first reference time which is determined by the first reset current by the above-mentioned predetermined time. Consequently, the more people are detected by the detecting device 20, the more frequently the urinals 14 will be flushed.

When the first timer is reset at last, it is immediately inverted. Then the set current automatically starts flowing through the first timer. At the same time, the bistable flip-flop circuit 35 is reset by an output signal of the timer 46 for controlling the solenoid-controlled valve 22, and thus made ready to convert a binary-coded signal "0" into a binary-coded signal "1" upon receipt of an output signal of the gate circuit 32.

Figure 5:
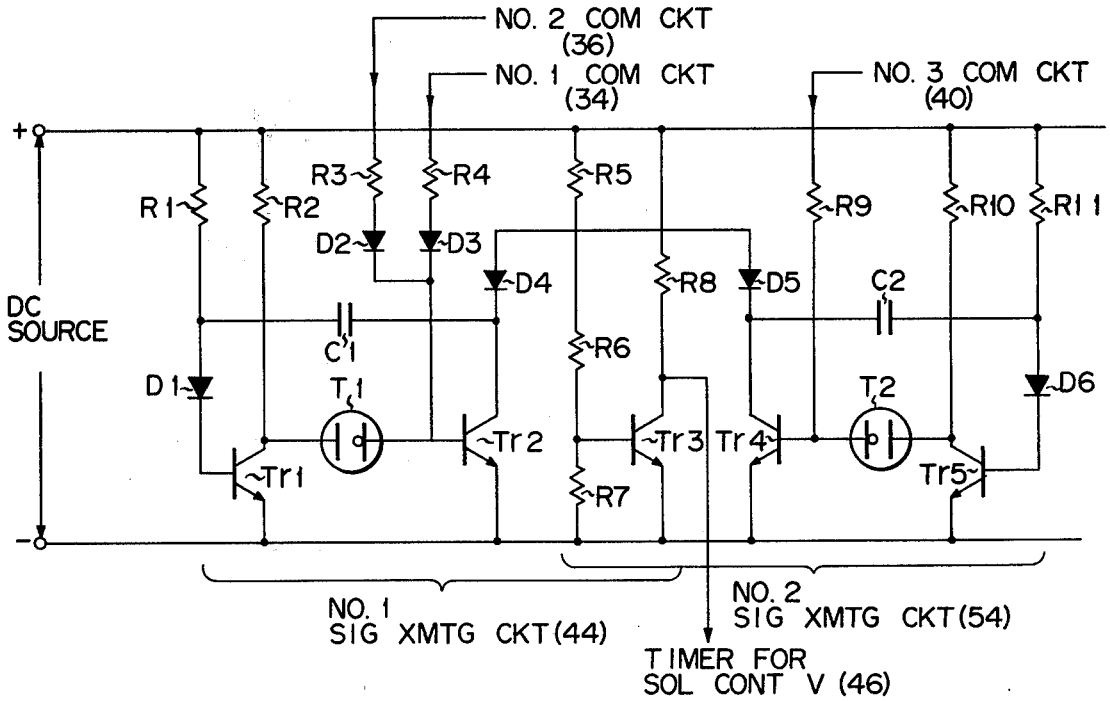
FIG. 5 shows the circuitry of the first signal-transmitting circuit and the second signal-transmitting circuit, both shown in FIG. 3.

The third command circuit 58 includes a variable resistor 62. If the detecting device 20 detects no person right after each flushing of the urinals 14, a binary-coded signal "1" is supplied to the third command circuit 58 via the NOT circuit 38. In response to the binary-coded signal "1" a second reference reset current flows to the second timer of the second signal-transmitting circuit 54 through the resistor 62 and a resistor $R_9$ disposed in the second signal-transmitting circuit 54. The second timer is in a specific set state as will be described later. Upon lapse of the second reference time after the second reset current has flowed through the second timer, the second timer is reset. Then, the voltage between the first and second electrodes of the second timer is elevated abruptly. This voltage rise is taken out as a trigger signal, which is amplified by an amplifier (not shown) provided in the second signal-transmitting circuit 54. The output signal of the amplifier is supplied to the timer 46. Thus, the urinals 14 are flushed upon lapse of the second reference time after the previous flushing of the urinals 14. The second timer is so arranged as shown in FIG. 5 and is brought into set state right after it has been reset. Thus, so long as no person is detected by the detecting device 20, the urinals 14 are flushed automatically every time the second reference time lapses.

With reference to FIG. 5 it will be explained how the first and second signal-transmitting circuits 44 and 54 operate.

The first signal-transmitting circuit 44 includes a first timer $T_1$, transistors $T_{r1}$ and $T_{r2}$, a resistor $R_1$, a diode $D_1$. Further provided is a capacitor $C_1$ which has one end connected to the collector of the transistor $T_{r2}$. The other end of the capacitor $C_1$ is connected to the junction between the resistor $R_1$ connected to the positive terminal a DC source and the diode $D_1$ connected to the base of the transistor $T_{r1}$. Through the first timer $T_1$ there flows a set current $I_s$ to the right in FIG. 5. Current $I_s$ is determined by the resistance of a resistor $R_2$ and flows through the first timer $T_1$ for a time $T_s$ which is defined as: $T_s = 0.7R_1 \cdot C_1$. While set current $I_s$ is flowing through the first timer $T_1$, the transistors $T_{r1}$ and $T_{r2}$ are kept off and on, respectively. Upon lapse of time $T_s$, the timer $T_1$ is set to have electric charge of $T_s \cdot I_s$. Thereafter it remains set until a reset current starts flowing through it.

When a first person is detected by the detecting device 20, the first reset current $I_c$ is supplied from the first command circuit 34 to the first timer $T_1$ through the resistor $R_4$. While the first reset current $I_c$ is flowing through the first timer $T_1$, electrolysis proceeds in the first timer $T_1$, and the transistors $T_{r1}$ and $T_{r2}$ are kept on and off, respectively. When the first timer $T_1$ is finally reset, the voltage between the first and second electrodes of the first timer $T_1$ is elevated so much that the transistor $T_{r2}$ is turned on, too. At this time a negative voltage is applied to the base of the transistor $T_{r1}$ via a capacitor $C_1$. As a result, the transistor $T_{r1}$ is turned off and thereafter remains off for time $T_s$ ($= 0.7R_1 \cdot C_1$). During this period the first timer $T_1$ is automatically set again. Once in a set state, the first time $T_1$ remains so until the first reset current $I_c$ flows through it again. The time $T_c$ during which the first timer $T_1$ is completely reset after the first reset current $I_c$ has started to flow through the first timer $T_1$, i.e. the first reference time, is represented by the following equation:

$$T_c = I_s \cdot T_s / I_c.$$

If a second person is detected by the detecting device 20 before the first reset current $I_c$ finishes flowing through the first timer $T_1$, an additional reset current $\Delta I_c$ is supplied to the first timer $T_1$ from the second command circuit 36 via the resistor $R_3$. The additional reset current $\Delta I_c$ flows through the first timer $T_1$ for a time $\Delta T_c$ which corresponds to the pulse width of the output signal of the gate circuit 32. Before the first timer $T_1$ is reset, there elapses some time which is expressed as: $t = \Delta I_c \times \Delta T_c / I_c$. Consequently, the first reference time $T_c$ is shortened by said time t.

Similarly, if a third person is detected by the detecting device 20 before the first reset current $I_c$ finishes flowing through the first timer $T_1$, the additional reset current $\Delta I_c$ flows again through the first timer $T_1$. As a result, the first reference time $T_c$ is made shorter by 2t. If persons are detected thereafter before the first reset current $I_c$ finishes flowing through the first timer $T_1$, the first reference time $T_c$ becomes shorter by t for each person detected.

Upon lapse of the first reference time $T_c$, the first timer $T_1$ is reset completely. The transistor $T_{r2}$ is then turned on, causing a voltage drop in its collector. This voltage drop is transmitted to a transistor $T_{r3}$ through a resistor device comprised of serially connected registors $R_5$, $R_6$ and $R_7$. In response to the voltage drop the collector of the transistor $T_{r3}$ delivers an output signal to the timer 46. As a result, the solenoid-controlled valve 22 is opened to flush the urinals 14.

The second signal-transmitting circuit 54 is similar to the first signal-transmitting circuit 44 in basic construction. It comprises transistors $T_{r4}$ and $T_{r5}$, resistors $R_9$, and $R_{10}$ and $R_{11}$ and a capacitor $C_2$. The transistors $T_{r4}$ and $T_{r5}$ correspond to the transistors $T_{r2}$ and $T_{r1}$ of the first signal-transmitting circuit 44. The resistors $R_9$, $R_{10}$ and $R_{11}$ correspond to the resistors $R_4$, $R_2$ and $R_1$ of the circuit 44, respectively, and the capacitor $C_2$ corresponds to the capacitor $C_1$ of the circuit 44. The second signal-transmitting circuit 54 does not need a resistor equivalent to the resistor $R_3$ of the circuit 44. This is because no additional reset current flows through the second timer $T_2$ in the second signal-transmitting circuit 54.

Current $I_{s2}$ determined by the resistor $R_{10}$ is made to flow through the second timer $T_2$ for some time which is expressed as: $T_{s2} = 0.7R_{11} \cdot C_2$. This current $I_{s2}$ sets the second timer $T_2$. When the second reset current $I_{c2}$, which is determined by the resistor 62 of the third command circuit 58 and the resistor $R_9$, flows through the second timer $T_2$, the second timer $T_2$ starts. The second timer $T_2$ is reset thereafter upon lapse of the second reference time $T_{c2}$ which is represented by the following equation:

$$T_{c2} = (I_{s2} \cdot T_{s2} / I_{c2}).$$

Every time the second timer $T_2$ is reset, the second signal-transmitting circuit 54 delivers an output signal to the timer 46. Thus, the solenoid-controlled valve 22 is opened to flush the urinals 14 every time the second reference time $T_{c2}$ elapses.

In the above-described embodiment the detecting device 20 uses ultrasonic waves. The device 20 need not be limited to this type. Instead, a photoelectric device or any other known detector may be employed to detect any person who enters the lavatory. Further, in place of the single transducer **20*a* which emits ultrasonic waves into the oblong space 20*a*, use may be made of a plurality of sensors such as transducers and photoelectric elements, each being suitable for scanning a space smaller than the space 20*a***.

In case a number of urinals are arranged in a row as shown in FIG. 1, those near the entrance of the lavatory are used more often than the others. Thus, if only some of the urinals near the entrance are scanned, the detecting device 20 can be simplified and can yet detects an approximate number of toilet users in a given time.

What is claimed is

1. An automatic flushing system for flushing a plurality of toilet bowls installed in a lavatory at various intervals according to the frequency at which the toilet bowls are used, the system comprising a detecting device for delivering a detection signal upon detecting each person entering the lavatory; a solenoid-controlled valve for flushing the toilet bowls; a first command circuit for delivering a first output signal in response to a detection signal delivered first from said detecting device after the flushing of the toilet bowls; a first signal-transmitting circuit having a first timer which starts upon receipt of the first output signal and stops upon lapse of a first reference time, thereby to deliver a second output signal when the first timer stops; a timer for delivering, upon receipt signal, a third output signal which lasts for a predetermined time to control the solenoid-controlled valve; means for actuating the solenoid-controlled valve upon receipt of the third output signal, thereby to flush the toilet bowls; a second command circuit for delivering a fourth output signal to the first signal-transmitting circuit upon receipt of every detection signal, in response to each detection signal delivered subsequent to the first one delivered after each flushing of the toilet bowls, thereby to set in said first timer a time shorter than the first reference time by a predetermined length; a third command circuit for delivering a fifth output signal after each flushing of the toilet bowls in case the detecting appliance delivers no detection signal; and a second signal-transmitting circuit having a second timer which starts upon receipt of the fifth output signal and stops every time a second reference time longer than the first one elapses, thereby to deliver, when the second timer stops, a sixth output signal to said timer so as to flush the toilet bowls.

2. An automatic flushing system according to claim 1, wherein said first and second timers are electrolytic cells each of which is put into set state when current starts flowing across its two electrode in one direction and into reset state when current starts flowing across its two electrode in the opposite direction and each of which is reset completely when the voltage across the electrodes is elevated abruptly.

3. An automatic flushing system according to claim 2, wherein said first command circuit has a bistable flip-flop circuit which is inverted in response to the detection signal delivered first from said detecting device after the flushing of the toilet bowls, thereby to supply a first reset current to said timer for controlling said solenoid-controlled valve.

4. An automatic flushing system according to claim 3, wherein said first signal-transmitting circuit has an amplifier means for amplifying the elevated voltage across the electrodes of said first timer and thus forming said second output signal to be supplied to said timer for controlling said solenoid-controlled valve.

5. An automatic flushing system according to claim 4, wherein said second command circuit has a resistor through which an additional reset current is supplied to said first timer for the time corresponding to the pulse width of the fourth output signal.

6. An automatic flushing system according to claim 5, wherein said third command circuit has a resistor through which the fifth output signal is supplied to said second signal-transmitting circuit in the form of a second reset current in case the detecting device delivers no detection signal after the flushing of the toilet bowls.

7. An automatic flushing system according to claim 6, wherein said second signal-transmitting circuit has an amplifier means for amplifying the elevated voltage across the electrodes of said second timer and thus forming said sixth output signal to be supplied to said timer for controlling said solenoid-controlled valve.

8. An automatic flushing system according to claim 1, further comprising a third signal-transmitting circuit for delivering, only when power supply to the system is started, a seventh output signal to said timer for controlling said solenoid-controlled valve, thereby to flush the toilet bowls.

9. An automatic flushing system according to claim 8, wherein said third signal-transmitting circuit is a timer which is closed at the start of power supply and opened upon lapse of a predetermined time thereafter.

* * * * *